US006079374A

United States Patent [19]

Yamamoto et al.

[11] Patent Number: 6,079,374

[45] Date of Patent: Jun. 27, 2000

[54] DEBRIS ENTRY PREVENTING MEMBER OF AIR-COOLED TYPE INTERNAL COMBUSTION ENGINE

[75] Inventors: Takayuki Yamamoto, Tokyo; Hiroji Kawasaki, Ohme, both of Japan

[73] Assignee: Kioritz Corporation, Tokyo, Japan

[21] Appl. No.: 09/122,110

[22] Filed: Jul. 24, 1998

[30] Foreign Application Priority Data

Jul. 29, 1997 [JP] Japan ..... 9-218074

[51] Int. Cl.[7] ..... F01P 5/06

[52] U.S. Cl. ..... 123/41.7

[58] Field of Search ..... 123/41.7, 198 E

[56] References Cited

U.S. PATENT DOCUMENTS

| | | | |
|---|---|---|---|
| 3,650,250 | 3/1972 | Lohr et al. | 123/41.7 |
| 4,890,584 | 1/1990 | Tamba et al. | 123/41.7 |
| 5,168,837 | 12/1992 | Scholz | 123/41.7 |
| 5,283,490 | 2/1994 | Nolte et al. | 310/89 |
| 5,687,689 | 11/1997 | Santos | 123/41.7 |

FOREIGN PATENT DOCUMENTS

| | | | |
|---|---|---|---|
| 5-92424 | 12/1993 | Japan | F01P 5/06 |
| 9-287448 | 11/1997 | Japan | F01P 5/06 |

*Primary Examiner*—Willis R. Wolfe
*Assistant Examiner*—Jason Benton
*Attorney, Agent, or Firm*—Michael D. Bednarek; Crowell & Moring LLP

[57] ABSTRACT

A debris entry preventing member A of an air-cooled type internal combustion engine E is made of a flexible sheet material as a whole and includes a mounting portion 7 to be mounted on a mounting component 15, which will be attached to the internal combustion engine E, and a debris capturing portion 4 having a multiplicity of ventilation holes 5. When the mounting component 15 is attached to the internal combustion engine E, the debris entry preventing member A is mounted thereon together with the mounting component 15 so that the debris capturing portion 4 covers a cooling air intake port 11. As a result, a job for mounting the debris entry preventing member can be easily carried out, no screws and the like are needed for mounting it, the debris entry preventing member can be easily manufactured and its cost can be reduced. Accordingly, the debris entry preventing member contributes to the reduction of weight of the air-cooled type internal combustion engine and a portable working machine on which the air-cooled type internal combustion engine is mounted as a power source.

11 Claims, 3 Drawing Sheets

DEBRIS ENTRY PREVENTING MEMBER OF AIR-COOLED TYPE INTERNAL COMBUSTION ENGINE

BACKGROUND OF THE INVENTION

The present invention relates to a debris entry preventing member for preventing debris from being sucked in through a cooling air intake port of an air-cooled type internal combustion engine into the interior of the engine.

In an air-cooled type internal combustion engine such as a small two-cycle gasoline engine and the like which is mounted on various types of portable working machines such as, for example, a bush cutter, a power blower, a hedge trimmer and the like as a power source, debris such as wood chips, leaves, twigs, grass and the like may be sucked in through a cooling air intake port formed to a fan case of the internal combustion engine while the working machines are in operation. There is caused in such a case a problem that a cooling fan in the fan case is damaged or the operation thereof is prevented or a cooling effect is lowered due to the debris adhered to and deposited on cooling fins of a cylinder of the engine.

To prevent the entry of the debris, there has been employed means arranged such that a rib-shaped static blade which extends so as to across the cooling air intake port is formed integrally with a fan case or a lattice-shaped component made of synthetic resin is fitted in a cooling air intake port making use of the elastic deformation thereof to prevent the entry of the debris.

However, the manufacture of the rib-shaped static blade and the lattice-shaped component is time consuming and they have a limit in the reduction of a cost and weight.

SUMMARY OF THE INVENTION

An object of the present invention made in view of the above circumstances is to provide a debris entry preventing member of an air-cooled type internal combustion engine capable of preventing debris from being sucked in through a cooling air intake port of an engine as well as being easily manufactured and mounted and reducing the cost and weight of a portable working machine.

To achieve the above object, a debris entry preventing member of an air-cooled type internal combustion engine according to the present invention is made of a flexible sheet material as a whole. The debris entry preventing member includes a mounting portion to be mounted on a component, which will be attached to the air-cooled type internal combustion engine in the vicinity of a cooling air intake port thereof, and a debris capturing portion for capturing debris which tends to flow into the interior of the internal combustion engine. These mounting portion and debris capturing portion are formed integrally with the debris entry preventing member. The debris capturing portion has a multiplicity of ventilating holes formed thereto.

When the component is attached to the internal combustion engine, the debris capturing portion according to the present invention is mounted on the internal combustion engine together with the component so as to cover the cooling air intake port. With this arrangement, no screws and the like are needed to mount the debris entry preventing member. Accordingly, the debris entry preventing member contributes to the reduction of weight of the internal combustion engine as a whole.

Since the debris entry preventing member according to the present invention is made of a flexible sheet material, it has the following advantages. First, when the debris entry preventing member is mounted, it can be freely deformed in accordance with the portion where it is mounted and thus a job for mounting it can be easily carried out. Second, the multiplicity of ventilating holes can be easily formed by, for example, stamping. Therefore, the debris entry preventing member can be very easily manufactured in accordance with air-cooled internal combustion engines of various models as well as the cost thereof can be reduced. Third, the debris entry preventing member is light in weight. Therefore, it contributes to the reduction of weight of various types of working machines such as a bush cutter, a power blower, a hedge trimmer and the like.

DESCRIPTION OF THE PREFERRED EMBODIMENT

Figure 2:
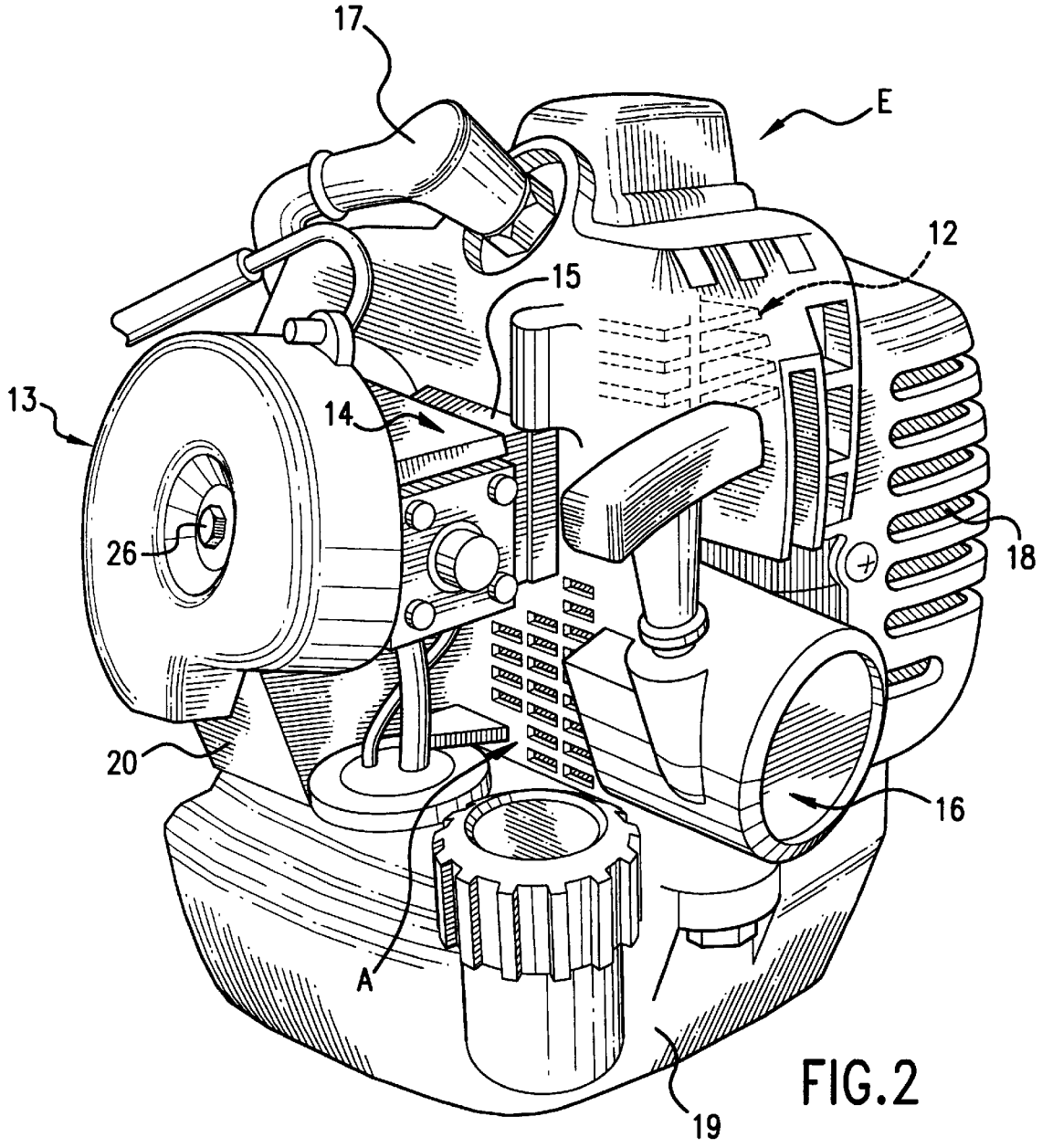
FIG. 2 is a perspective view showing how the debris entry preventing member of the air-cooled type internal combustion engine shown in FIG. 1 is mounted.

In FIG. 2, numeral 12 denotes a cylinder of an air-cooled type internal combustion engine E, numeral 13 denotes an air cleaner, numeral 14 denotes a diaphragm carburetor, numeral 15 denotes a heat insulator, numeral 16 denotes a recoil starter, numeral 17 denotes an ignition plug, numeral 18 denotes an exhaust gas muffler and numeral 19 denotes a fuel tank.

Figure 3:
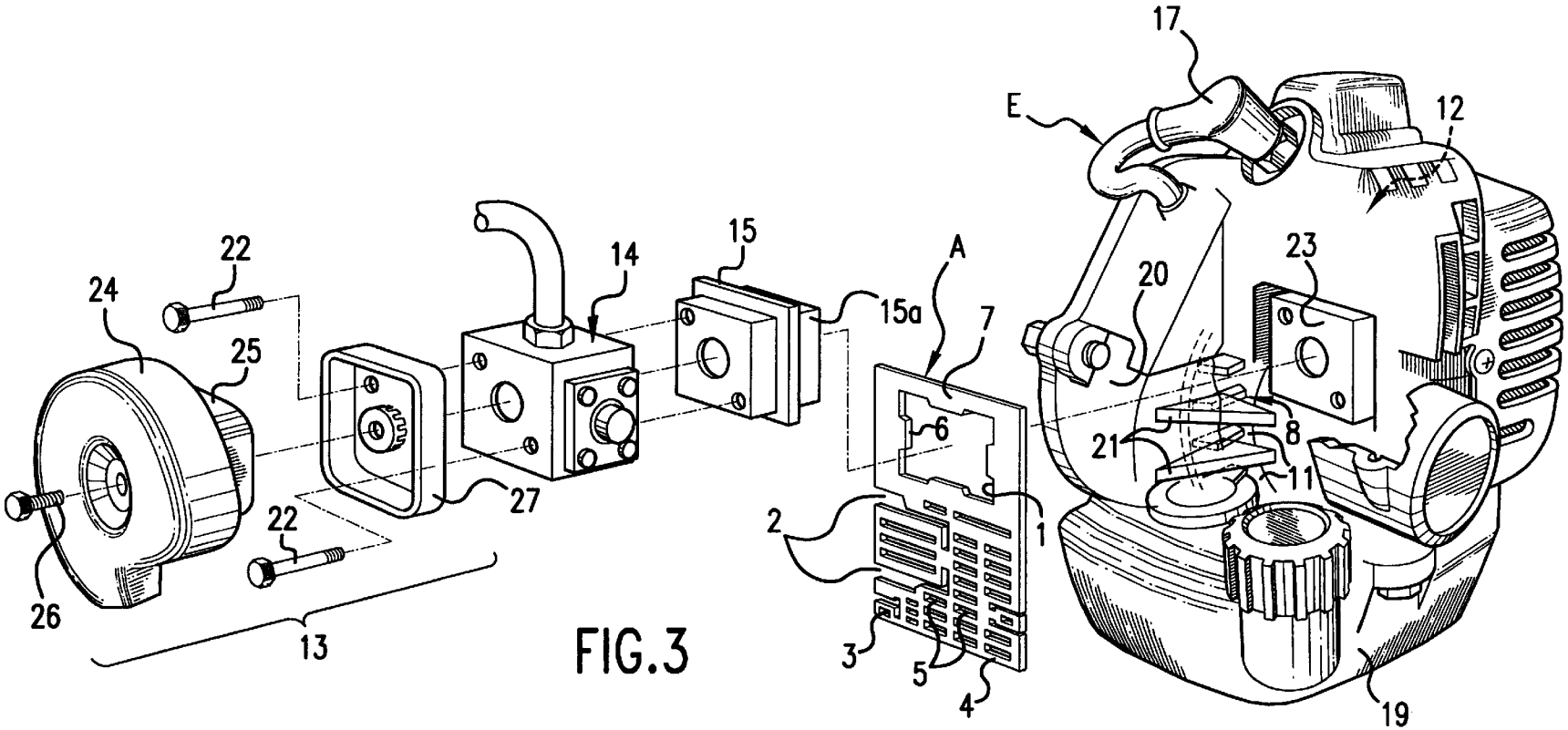
FIG. 3 is an exploded perspective view of the portion of the engine shown in FIG. 2 where the debris entry preventing member is mounted.

In FIG. 3, numeral 8 denotes a cooling fan of the internal combustion engine E, numeral 20 denotes a fan cover for covering the cooling fan 8, numeral 11 denotes a cooling air intake port formed to a lower portion of the fan cover 20 and numeral 21 denotes ribs for reinforcing the portion around the cooling air intake port 11. While the internal combustion engine E is in operation, the cooling fan 8 takes air from the cooling air intake port 11 and cools the cylinder 12, exhaust muffler 18 and the like. A debris entry preventing member A according to an embodiment of the present invention is mounted on the internal combustion engine E so as to cover the cooling air intake port 11.

Figure 1:
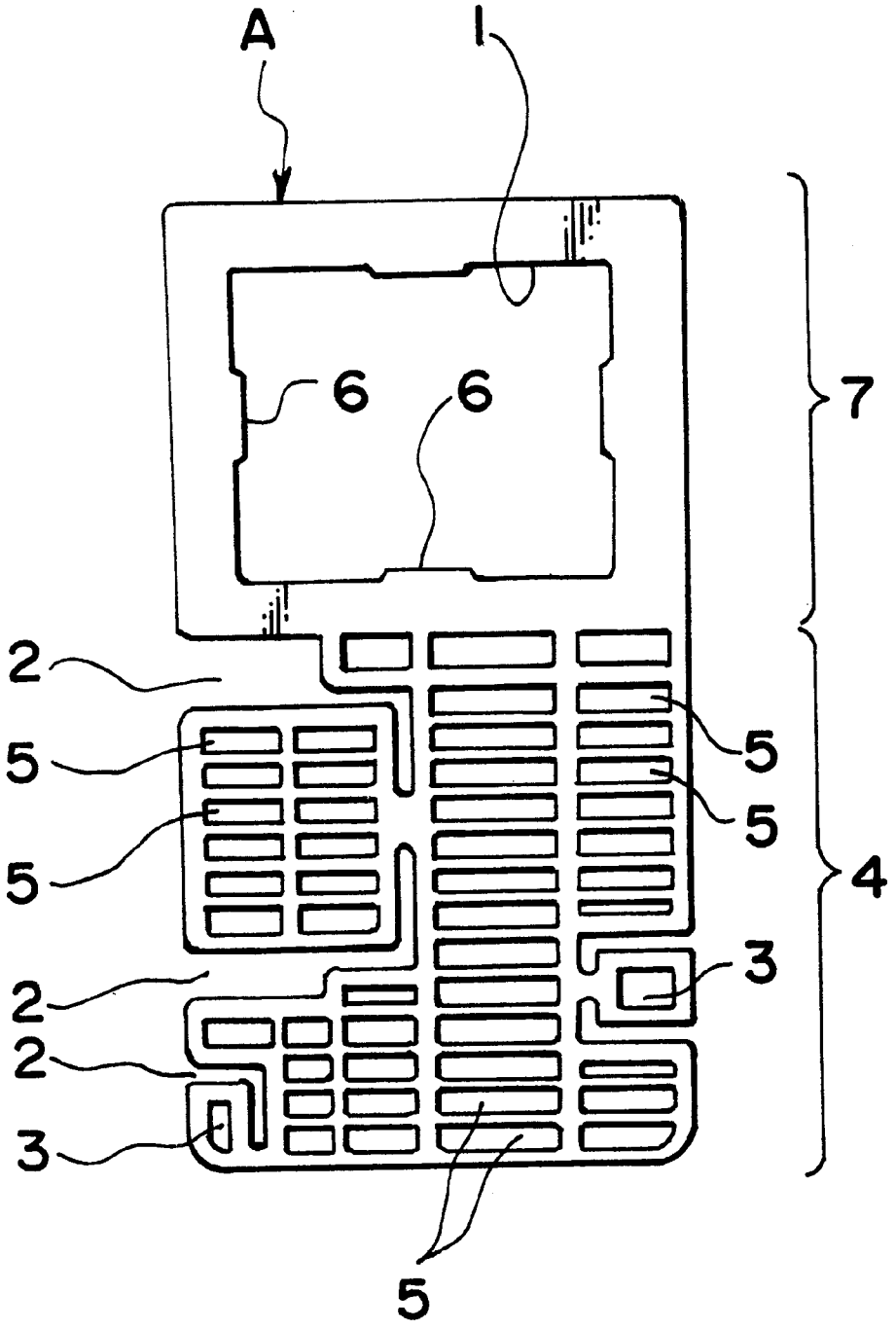
FIG. 1 is a plan view of an example of a debris entry preventing member of an air-cooled type internal combustion engine according to the present invention.

Referring to FIG. 1, the debris entry preventing member A is made of a flexible thin sheet material such as, for example, a nylon sheet of about 0.5 mm thick as a whole. The debris entry preventing member A includes a mounting portion 7 to be mounted on a component, which will be attached to the engine E in the proximity of the cooling air intake port 11, and a debris capturing portion 4 for capturing debris which tends to flow into the fan cover 20 in response to the air sucking action of the cooling fan 8. The mounting portion 7 and the debris capturing portion 4 are formed to the debris entry preventing member A integrally therewith.

In the embodiment, a mounting hole 1 is formed to the mounting portion 7 of the debris entry preventing member A so as to be fitted to the mounting portion 15*a* of the heat insulator 15 as the above component which will be attached to the internal combustion engine E through the mounting portion 15*a*. The mounting hole 1 has a suitable number of tongue pieces 6 formed to the inner edge thereof and the tongue pieces 6 are used to position the debris entry preventing member A when it is mounted.

The debris capturing portion 4 of the debris entry preventing member A has a multiplicity of ventilation holes 5 formed thereto. The respective ventilation holes 5 are set to such a size that they can capture all the wood chips, cut grass, dead grass and the like and the shape of the holes 5 may be any of a circle, oval, lattice and the like.

The debris entry preventing member A also has slits 2 for receiving the ribs 21, which act as impediments when the debris entry preventing member A is mounted on the internal combustion engine E, and holes 3 for receiving impediments such as other projections and the like which are formed to the outside surface of the internal combustion engine E. As a result, since the debris entry preventing member A is fitted to the internal combustion engine E, there is no space through which the debris escapes and an excellent debris entry preventing effect can be obtained. The mounting hole 1, the slits 2, the holes 3 and the multiplicity of ventilation holes 5 can be easily formed by stamping.

When, for example, the heat insulator 15 is attached to the internal combustion engine E, the debris entry preventing member A is also mounted thereon together with the heat insulator 15 as shown in FIG. 3. More specifically, the mounting hole 1 of the debris entry preventing member A is first fitted to the mounting portion 15*a* of the heat insulator 15 and then the debris entry preventing member A is mounted on the heat insulator 15. Thereafter, the heat insulator 15 to which the debris entry preventing member A is mounted is attached to the mounting surface 23 of the cylinder 12 by means of mounting screws 22 together with the diaphragm carburetor 14 and a cleaner case 27 constituting the air cleaner 13. When the debris entry preventing member A is mounted on the internal combustion engine E in the state described above, the debris capturing portion 4 thereof covers the cooling air intake port 11. Debris such as leaves, twigs or grass is captured by the debris capturing portion 4 and only the cooling air from the multiplicity of ventilation holes 5 is sucked into the interior of the internal combustion engine E. Since the debris entry preventing member A is flexible as a whole, it can be freely deformed in accordance with the outside shape of the internal combustion engine E. Therefore, it can be mounted on the internal combustion engine E without leaving any space therebetween as well as a job for mounting it can be easily carried out.

In FIG. 3, numeral 24 denotes a cleaner case cover in which an air filter element 25 and the like are accommodated and numeral 26 denotes a screw for mounting the cleaner case cover 24.

The entire configuration of the debris entry preventing member A can be variously designed in accordance with the configuration of the cooling air intake port 11. When, for example, a cooling air intake port extends long in a semicircular shape so as to run along the outside periphery of a crank case of an internal combustion engine, it is preferable that a debris entry preventing member is formed long in correspondence to the cooling air intake port and mounted in a curved state in accordance with the curved shape of the cooling air intake port so that it entirely covers the cooling air intake port. In this case, the extended extreme end of the debris entry preventing member may be fixed to, for example, the exhaust muffler 18. Further, a plurality of the debris entry preventing members A shown in FIG. 1 may be used in accordance with the size and shape of the cooling air intake port.

What is claimed is:

1. A debris entry preventing member of an air-cooled type internal combustion engine which is mounted on the internal combustion engine to prevent debris from being sucked into the interior of the internal combustion engine together with cooling air from a cooling air intake port, integrally comprising:

a mounting portion to be mounted on a mounting component which will be attached to the internal combustion engine; and a debris capturing portion having a multiplicity of ventilation holes for covering the cooling air intake port and capturing the debris when the debris entry preventing member is mounted on the internal combustion engine together with the mounting component, wherein said mounting portion and said debris capturing portion are formed integrally with the debris entry preventing member and the debris entry preventing member is made of a freely deformable material.

2. A debris entry preventing member of an air-cooled type internal combustion engine according to claim 1, comprising a slit for receiving an impediment formed to the internal combustion engine.

3. A debris entry preventing member of an air-cooled type internal combustion engine according to claim 2, wherein said slit and said multiplicity of ventilating holes are formed by stamping.

4. A debris entry preventing member for use in an air-cooled type internal combustion engine, the debris entry preventing member being made as a single piece formed entirely of flexible sheet material so that the debris entry preventing member has two sides that are substantially flat and the one-piece debris entry preventing member comprising cut out portions defining:

a mounting portion that is freely deformable for mounting to a single mounting component that is adapted to be attached to the internal combustion engine such that the debris entry preventing member is mounted to the mounting component which is mounted to the air cooled type internal combustion engine; and a debris capturing portion having a plurality of ventilation holes for covering the cooling air intake port and capturing debris when the debris entry preventing member is mounted on the internal combustion engine together with the mounting component.

5. The debris entry preventing member of claim 4, wherein the mounting portion includes a single mounting hole that allows the mounting portion to be mounted to the single mounting component that is adapted to be attached to the internal combustion engine and wherein at least one tongue piece is provided on an edge of the mounting hole to allow positioning of the debris entry preventing member when it is mounted.

6. The debris entry preventing member of claim 4, wherein the mounting portion and debris capturing portion are stamped from a single sheet of flexible material.

7. The debris entry preventing member of claim 4, wherein the mounting portion and debris capturing portion lie on a single plane.

8. A debris entry preventing member for use in an air-cooled type internal combustion engine, the debris entry preventing member being made as a single piece formed entirely of flexible sheet material so that the debris entry preventing member has two planar sides, and the one-piece debris entry preventing member comprising cut out portions defining:

a mounting portion that is freely deformable for mounting to a mounting component that is adapted to be attached to the internal combustion engine such that the debris entry preventing member is mounted to the air cooled type internal combustion engine via the mounting component; and a debris capturing portion having a plurality of ventilation holes for covering the cooling air intake port and capturing debris when the debris entry preventing member is mounted on the internal combustion engine together with the mounting component.

9. The debris entry preventing member of claim 8, wherein the mounting portion includes a single mounting hole that allows the mounting portion to be mounted to a single mounting component that is adapted to be attached to the internal combustion engine and wherein at least one tongue piece is provided on an edge of the mounting hole to allow positioning of the debris entry preventing member when it is mounted.

10. The debris entry preventing member of claim 8, wherein the mounting portion and debris capturing portion are stamped from a single sheet of flexible material.

11. The debris entry preventing member of claim 8, wherein the mounting portion and debris capturing portion lie on a single plane.

* * * * *